US005902075A

United States Patent [19]

Krings

[11] Patent Number: 5,902,075

[45] Date of Patent: May 11, 1999

[54] TRENCH FALSEWORK SYSTEM

[75] Inventor: Josef Krings, Heinsberg, Germany

[73] Assignee: Wolfgang Richter, Hurtgenwald, Germany

[21] Appl. No.: 08/793,977

[22] PCT Filed: Aug. 4, 1995

[86] PCT No.: PCT/DE95/01045

§ 371 Date: May 2, 1997

§ 102(e) Date: May 2, 1997

[87] PCT Pub. No.: WO96/08609

PCT Pub. Date: Mar. 21, 1996

[30] Foreign Application Priority Data

Sep. 12, 1994 [DE] Germany ..... 44 32 319
Dec. 10, 1994 [DE] Germany ..... 94 19 834 U

[51] Int. Cl.[6] ..... E02D 3/02; E02D 17/04

[52] U.S. Cl. ..... 405/282; 405/283; 405/251; 52/780

[58] Field of Search ..... 405/251, 282, 405/283; 403/3, 4, 300, 305; 52/271, 426, 434, 435, 580, 775, 780

[56] References Cited

U.S. PATENT DOCUMENTS

| | | | |
|---|---|---|---|
| 2,633,713 | 4/1953 | Shields | 405/282 |
| 2,657,554 | 9/1953 | Davey | 403/300 X |
| 3,347,049 | 10/1967 | Keine . | |
| 3,593,528 | 7/1971 | Pavese . | |
| 4,033,138 | 7/1977 | Griswold | 405/283 |
| 4,056,938 | 11/1977 | Griswold | 405/283 |
| 4,114,383 | 9/1978 | Nieber | 405/282 |
| 4,498,802 | 2/1985 | Del Tufo et al. | 403/300 |
| 5,180,256 | 1/1993 | Krings | 405/282 |
| 5,277,522 | 1/1994 | Pertz | 405/272 X |
| 5,527,137 | 6/1996 | Spencer | 405/283 |
| 5,664,382 | 9/1997 | Melnick et al. | 52/271 X |
| 5,709,058 | 1/1998 | Shaw | 52/780 X |

FOREIGN PATENT DOCUMENTS

| | | |
|---|---|---|
| 26 24 954 A1 | 12/1977 | Germany . |
| 20 57 263 | 5/1978 | Germany . |
| 42 09 675 C1 | 7/1993 | Germany . |

*Primary Examiner*—Tamara L. Graysay
*Assistant Examiner*—Jong-Suk Lee
*Attorney, Agent, or Firm*—Kennedy Covington Lobdell & Hickman, LLP

[57] ABSTRACT

Proposed is a trench falsework which includes a base box (3) made up of lining panels (5) held apart by braces (8). The panels making up the box have a flat edge (7) along the top and a cutting edge (6) along the bottom. The falsework system also includes at least one add-on box (4, 12) designed to be used as an extra tier and made up of lining panels (5) which meet flush with those of the base box (3). The invention calls for the lining panels (5) making up the raised box (4, 12) to be of the same design as those in the base box (3).

19 Claims, 5 Drawing Sheets

Fig.7 A B
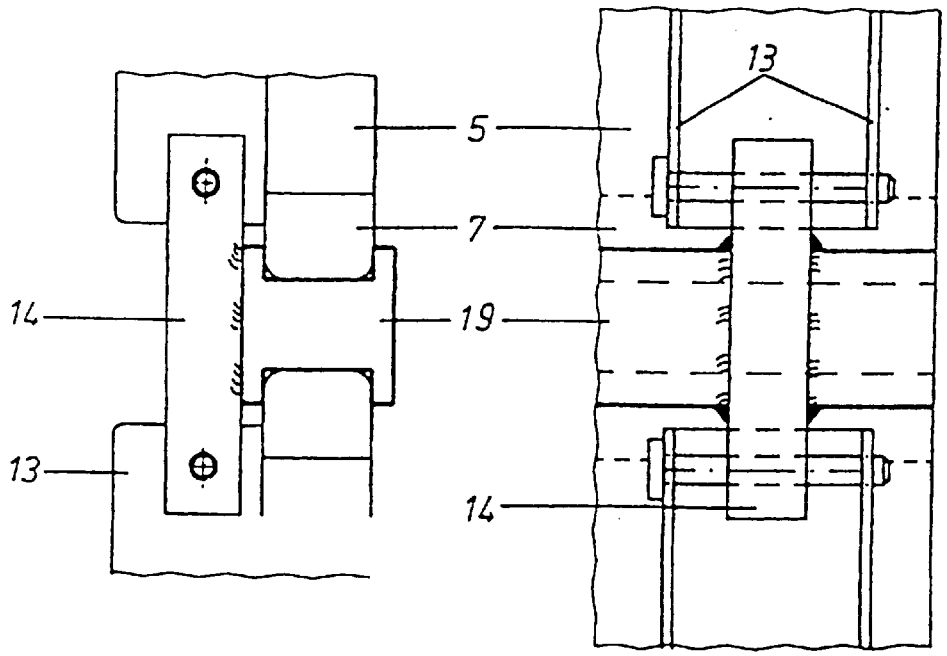
Fig.8 A B
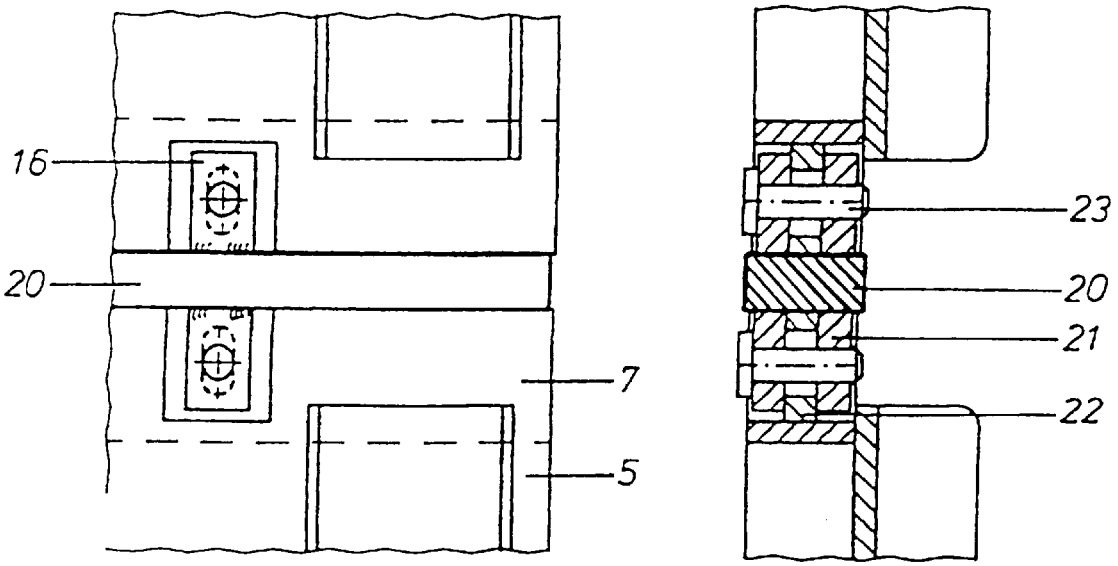

Fig. 9
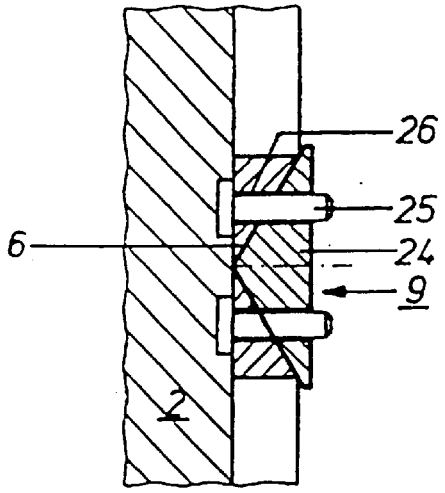
Fig. 10
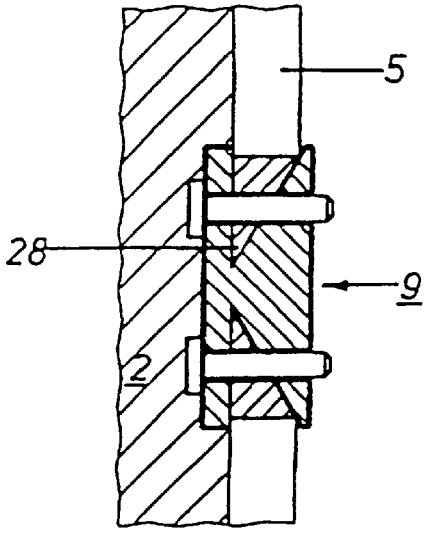
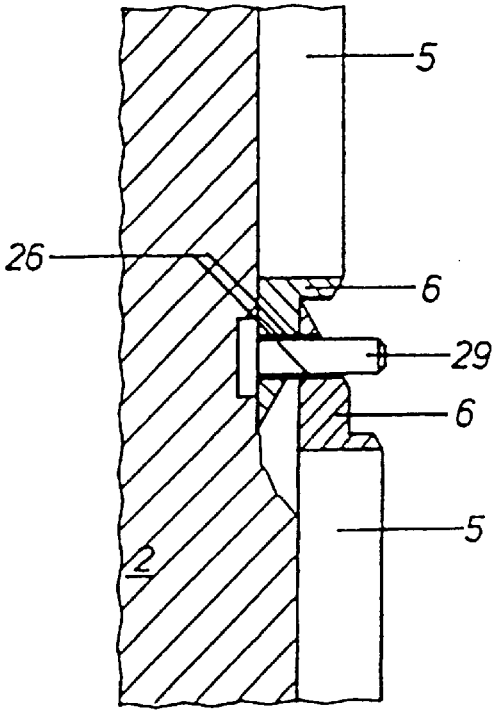
Fig. 11

TRENCH FALSEWORK SYSTEM

BACKGROUND OF THE INVENTION

1. Field of the Invention

The invention relates to a trench lining device (lining box) consisting of a base box of lining plates, kept apart by braces, which have a blunt edge, in particular a square pressure cross beam, which is relatively stable against blows of an excavator bucket, on their upper edge, and on the underside of each lining plate a cutting edge for forcing the base box downward into the ground, and with at least one tier of lining plates of a raised box arranged aligned on the base box.

2. Description of the Related Art

A device for shoring trench walls with at least two support walls of wall sections disposed on top of each other is described in DE 20 57 263 C3. The walls are kept at a distance from each other with the aid of cross braces. The lower pair of support walls ("base box" for simplicity) has a cutting edge at the lower edge, which is intended to be driven into the ground, while the upper edge of the plate located opposite the cutting edge is embodied as a blunt edge, for example as a square pressure cross beam. The raised boxes, which are intended to be arranged in tiers above the base box of plates in essentially a vertically aligned manner and which consist of pairs of plates, have a blunt (straight or slightly arched) end profile or the previously mentioned blunt edge, on both the upper and the lower edges. i.e. no cutting edge. The lining plates of the raised boxes essentially differ from the lining plates of the base boxes only by a cutting edge being provided or not. The cutting edge makes it possible to press the base box into the ground. The raised box does not require this cutting edge because it rests on the base box, which has already cut the soil to the width of the trench.

The essential disadvantage when using special raised elements or boxes lies in that they are only used for raising, that is only with relatively deep trenches. The base box is always needed in contrast to this. The raised box only in rare cases, but then at least one raised box is needed for every base box. Therefore the building contractor is required to keep approximately as many raised boxes as base boxed in storage if he is to be prepared to fill orders flexibly, even though the raised boxes are not even required at normal trench depths.

SUMMARY OF THE INVENTION

It is the object of the invention to create a trench lining device which can make do without the raised box which, in accordance with what has been said before, must be considered to be uneconomical, even in those cases where the height of the ground box is insufficient for lining the respective trench because of the required trench depth.

For the trench lining device with at least one tier of raised elements on a base box, the attainment of the object in accordance with the invention consists in that the raised elements of the lining boxes are designed the same as the lining plates of the base box. Connecting means, such as protective rails and/or screw connections, are preferably provided at the joint lines of lining plates placed on top of each other, which prevent the mutual displacement during driving into the ground and possible their separation in the course of the removal of the lined plates.

Thus, in accordance with the invention the trench lining device consists essentially only of the base boxes with connecting plates, which have a cutting edge along one longitudinal side for driving them into the ground. In the course of digging a trench first the base box is driven into the ground with the cutting edge at the bottom. Then a raised box is placed on the base box. The raised box can be alternatively positioned with the cutting edge up or with the cutting edge down. In the later case the cutting edge of the raised box and the top edge of the base box are intended to be connected with the aid of a protective rail, i.e. a connecting element, which protects the cutting edge and prevents the cutting edge from slipping off the top edge of the base box.

If, however, such as is preferred within the framework of the invention, the raised box rests with its blunt closing edge on the also blunt closing edge of the lining plates of the base box, connecting brackets which are bolted or screwed together, or perhaps welded on one side, are sufficient as connecting elements between the base box and the raised box, which prevent the raised box from sliding off and which are important, mainly in the course of removal, i.e. when the boxes are pulled out of the ground (when the trench is completed).

In accordance with the further invention, in an arrangement of pairs of lining plates placed on top of each other, which end on the upper edge with a cutting edge, a protective rail is applied, which should essentially consist of a profiled edge (preferably in the manner of a pressure cross beam) which, starting on one of its surfaces, has a recess extending into the profiled body over the length of the profile, into which the cutting edge is to be placed in an approximately interlocking manner. Such a protective rail is important in the case of a raised box being positioned with the cutting edge facing upward, since in general the box is pushed into the ground by means of the excavator bucket provided for excavating the trench. If the excavator bucket were to act directly on the cutting edge, bending of the cutting edge would be unavoidable. It is therefore important to provide a protective rail on each cutting edge in case of a lining which terminates with a cutting edge at the top.

Preferably the protective rail should extend over the entire length of the respective plate or cutting edge. However, in some cases, for example for reasons of savings, it can be practical to position a shorter protective rail respectively at those places, where the excavator bucket presses or even pounds on the plate.

The protective rail provided in accordance with the further invention is intended to have a recess over its entire length, into which the cutting edge is essentially to be placed in an interlocking manner. In principle this means that the recess can be designed throughout like the master mold of the cutting edge end of a base plate. If required, the master mold should extend over the entire length of the protective rail. But the part of the master mold which is interlockingly matched to the length of the rail can have breaks, provided the breaks to not reduce the rigidity and fixed position of the rail on the cutting edge. If, as is customary, the cutting edge consists of a one-sided chamfering of the respective plate edge, which in operation is intended to be facing the inside of the trench, it is sufficient for a complete recess to have individual brackets of the protective rail overlap the cutting edge on the outside of the plate situated opposite the cutting edge at distances which are sufficient to provide rigidity.

The protective rail in the narrower sense is placed on the upper edges of the lining plates of a lining box if in a two- or multi-tier lining box the cutting edges of the uppermost raised box face upward. In this case in particular the back or top of the edge profiles of the protective rail, which are situated opposite the recess which is intended to interlockingly receive the cutting edge, should preferably be approximately just as blunt as the oppositely located lining plate edge. Since in this case the protective rail is directly acted upon by the excavator bucket during driving the lining box into the ground, it must be so rigid that it (and particularly not the cutting edge located under it) can be bent or otherwise damaged by the excavator bucket. It also must be seated so securely on the cutting edge, preferably even without special fastening means, that it does not fall off the cutting edge during pushing or even beating with the excavator bucket. In this sense it is advantageous to shape the rail in such a way that its center of gravity lies as low as possible, preferably below the height of the edge of the cutting edge, when the protective rail is upended on the cutting edge. A rail, which interlockingly overlaps the cutting edge with its entire length, can be made relatively thin in the anvil section which is directly hit by the excavator bucket, so that the thickness of the anvil section is less in respect to the extension of the rail in the direction toward the adjoining plate surface. Preferably this ratio can lie in the range between values of 1:5 to 1:15.

For the case where, in a trench lining device with two or more tiers of base and raised boxes, a cutting edge meets a blunt edge or two cutting edges meet, it is provided in accordance with the further invention to provide an elongated clamp, which interlockingly extends around the cutting edges or, if required, the blunt edge, as the protective rail or connecting element at the transition point of lining plates placed on top of each other; the protective rail is preferably intended to prevent a direct mutual touching of lining plates placed on top of each other by means of a compensating plate (for example of one piece) placed between the joint lines. In this case, too, the interconnecting elements of the clamp-like protective rail can have breaks. In the same way a protective rail extending over the entire length of the two plates is also provided here, although it can be sufficient to support only individual elements by means of one or several partial protective rails.

In accordance with the further invention, the protective rails embodied as clamps are not only embodied for the mutual support of the lining plates, but should preferably also include connecting elements which make it possible during removal to pull the box respectively located at the bottom together with a box situated on top of it out of the trench by acting on the upper box. To this end the protective rails or clamps, which respectively interconnectingly overlap the cutting edges or blunt edges are intended to be fixedly connected with the respective plate edge or cutting edge, preferably with the aid of bores leading through the cutting edges or plates.

A building block system is created by means of the invention, which consists only of base plates or base boxes and connecting elements (for example protective rails). The conventionally required raised plates which, except for the cutting edge, are practically identical with the base plates, become completely unnecessary. Therefore the building contractor only needs to stock the conventional base plates and, in case that one pair of bases plates should not be sufficient for a trench depth, additionally only the connecting elements. A decisive advantage of the invention also lies in that in connection with lining using one base box and a single raised box, the latter is to be arranged with the cutting edge upward, and the cutting edge is to be perfectly secured against harmful actions of the excavator bucket with the aid of the protective rail resting interconnectingly on the rail.

In place of a multitude of special raised boxes which had to be stocked up to now, when using the invention it is generally sufficient to keep a pair of protective rails ready for each two pairs of base boxes. If a further raised box with the cutting edge facing upward is placed on the described arrangement with a protective rail, it is sufficient to have three pairs of base boxes and two pairs of protective rails in stock for a three tier trench lining device. Particularly for making the protective rails alternatively or in principle suitable also for the insertion between two tiers of lining elements, it is advantageous in accordance with the further invention to equip the protective rails with connecting elements for the fixed connection with the adjoining plate or plates, and with guide elements for preventing the mutual displacement of plates put on top of each other.

Details of the invention will be explained by means of the schematic representation of exemplary embodiments.

BRIEF DESCRIPTION OF THE DRAWINGS

FIGS. 5 to 8, examples of a mutual connection of lining plates arranged with a blunt edge on top of a blunt edge;

FIGS. 9 to 11, examples of a mutual connection of lining plates arranged with a cutting edge on top of a cutting edge;

DETAILED DESCRIPTION OF THE PREFERRED EMBODIMENTS

Figure 1:
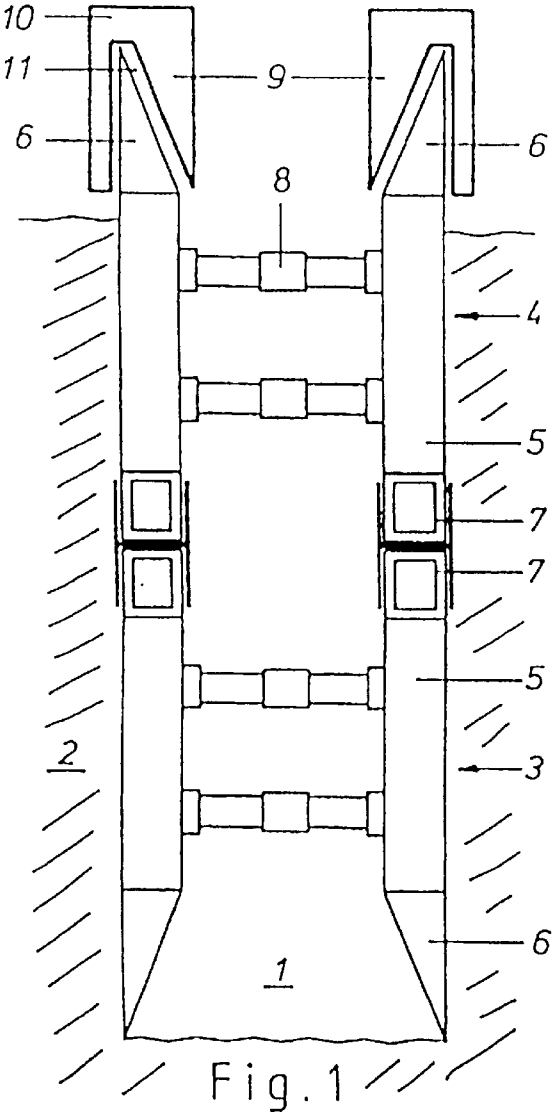
FIG. 1, a trench lining device with two tiers of lining boxes placed on top of each other.

FIG. 1 shows a base box 3 with a raised box 4 on top of it in a trench 1 in the surrounding soil 2. The boxes are made of lining plates 5 which are identical with each other. Each lining plate 5 has a cutting edge 6 on a longitudinal edge and, on the oppositely located longitudinal edge, a blunt edge 7 embodied, for example, as a square pressure cross beam. The lining plates of each box are maintained at a distance from each other in the conventional manner by braces 8 (see DE 42 09 675 C1). Respectively one protective rail 9 is located on the upward oriented cutting edges 6 of the raised box 4 and essentially consists of an edge profile 10, which is resistant to the action of the excavator bucket, and a recess 11 extending over the length of the profile from the direction of one of its surfaces into the profile body and which surrounds the cutting edge 6 essentially interlockingly. Accordingly the recess 11 should be considered as a master mold of the cutting edge 6, even though possibly with breaks which do not endanger its rigidity. The edge profile 10, which is possibly directly "worked on" by the excavator bucket, can also be called an anvil profile because of its correspondingly required rigidity.

Figure 2:
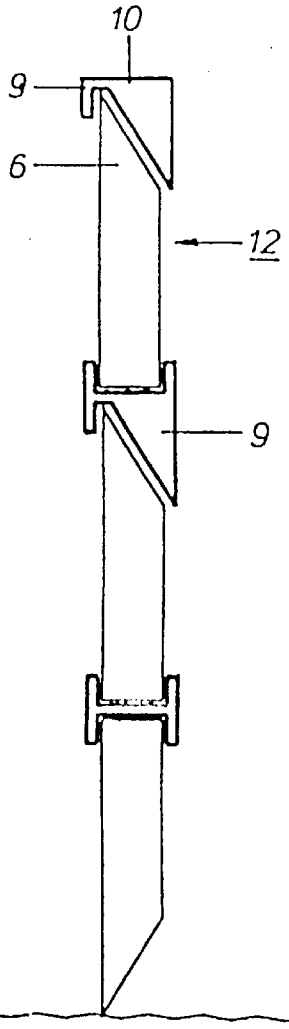
FIG. 2, a side of a trench lining device with three lining plates placed on top of each other in the sequence of blunt edge on blunt edge and blunt edge on cutting edge.

It is possible in accordance with FIG. 2 to essentially place a second raised box 12 on the structure of FIG. 1 (corresponding to a third tier of the trench lining device), also with an upward oriented cutting edge 6, wherein the upward oriented cutting edge 6 is also intended to be covered by a protective rail 9.

Figure 3:
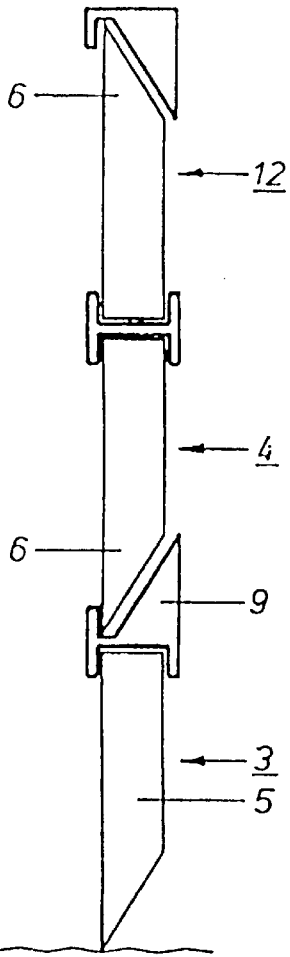
FIG. 3, a three tier trench lining device with three lining plates put on top of each other in the sequence of cutting edge on blunt edge and blunt edge on blunt edge.

If in accordance with FIG. 3 the first raised box 4 is placed on the respective lining plate 5 of the base box with the cutting edge 6 downward instead of upward, it is possible in principle to employ a "reversed" protective rail 9 as the connecting element, which constitutes the contact line between the boxes 3 and 4 positioned with the cutting edge on the blunt edge, on the connecting line between the base box 3 and the raised box 5. The second raised box 12 in FIG. 3 can also be positioned as in FIG. 2, i.e. with the cutting edge 6 pointing up. Alternatively it is possible in FIG. 3 for the second raised box 12 to be placed oriented the same as the first raised box 4 on the latter. A "reversed" protective rail 9 is then also arranged between the first and second raised boxes.

Figure 4:
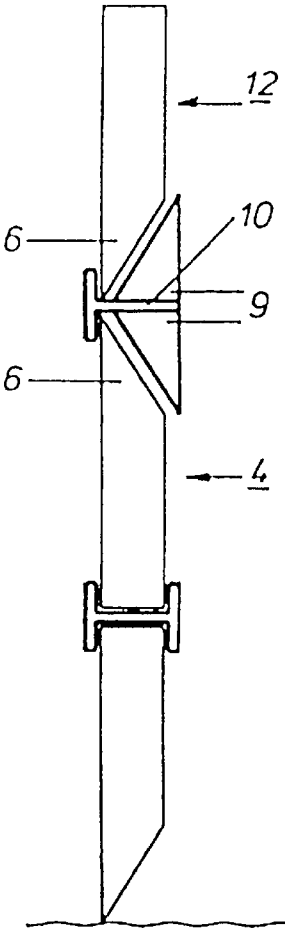
FIG. 4, a side of a trench lining device with three lining plates placed on top of each other in the sequence of blunt edge on blunt edge and cutting edge on cutting edge.

Besides the described mutual positioning of the blunt edge and the cutting edge, the placement of two lining boxes with cutting edge on cutting edge is possible in accordance with FIG. 4. In this case it is basically possible to provide a pair of "back to back" positioned protective rails 9 at the connecting line of the facing cutting edges 6, so that the plates 5 of the first raised box 4 and the second raised box 12 in FIG. 4 in the end rest on each other with the blunt sides, i.e. with the surface of the edge profile 10 located opposite the recess 11; in actual use it is preferred to make the back to back arrangement of the protective rail 9 available as one piece or fixedly connected, in particular welded together, from the outset.

For perfect functioning of the trench lining device in accordance with the invention it is not only sufficient to protect the cutting edges against damage by the excavator bucket acting thereon or (in this case also the blunt edges) against sliding off the upper edge of the downward aligned plate of a lining box, but it is also necessary to see to it that during removal the entire trench lining device can be lifted out of the trench by pulling on the topmost lining box. To this end it should also be possible to connect the lining boxes fixedly with each other in the direction of pull. Some exemplary embodiments of connecting means for lining boxes placed blunt edge to blunt edge on top of each other are shown in principle by means of FIGS. 5 to 8.

Figure 5:
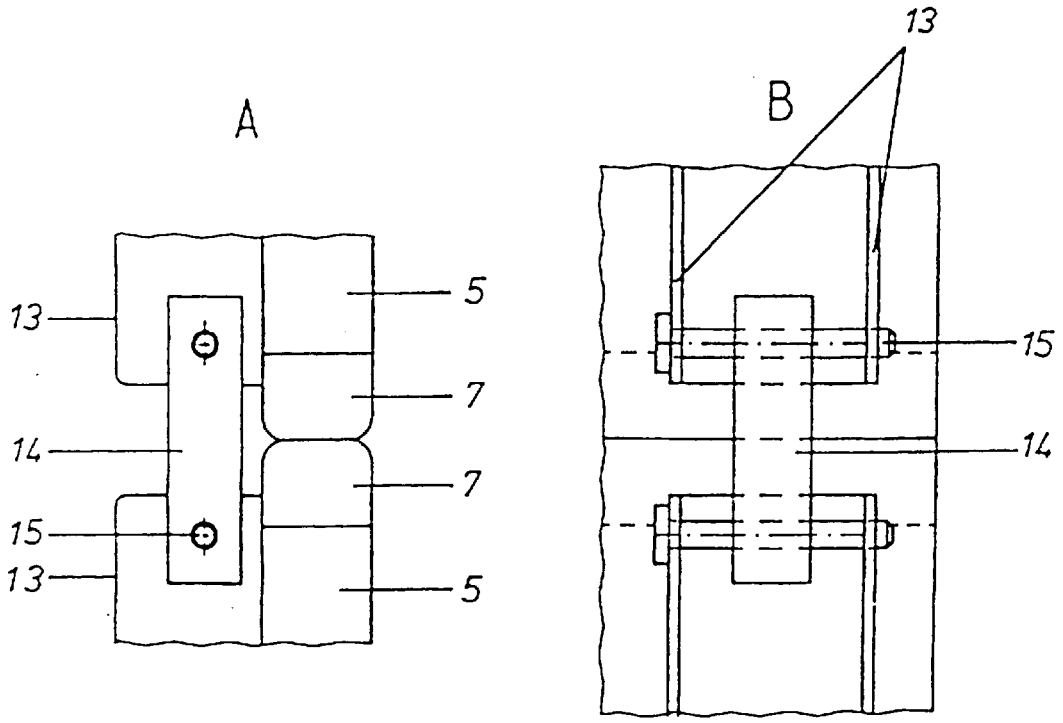

In accordance with FIG. 5 the two lining plates 5 resting on each other with the blunt edges 7 are connected with each other with the aid of brackets 13 and connecting elements 14, which are fixedly connected, for example by welding, with the respective plate 5, with the aid of releasable bolts 15. Part A of FIG. 5 represents a section vertically in respect to the plate plane, Part B of FIG. 5 represents a view of the connecting point with a pair of brackets 13 welded on the lining plate and with bores for the connecting element 14 and the bolts 15.

Figure 6:
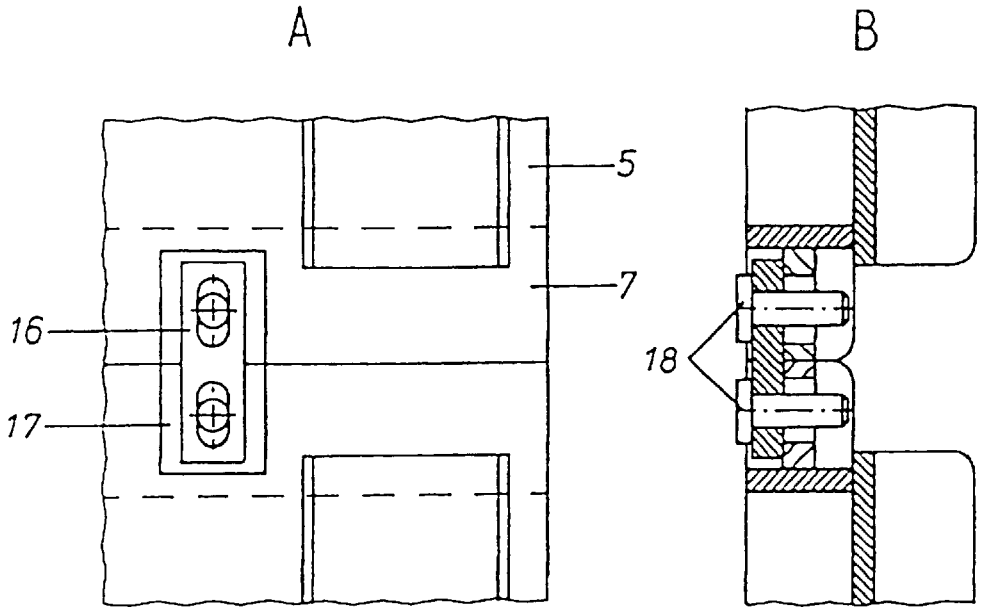

FIG. 6 represents an alternative to FIG. 5, wherein the two blunt edges 7 are releasably connected with each other with the aid of a bracket 16, preferably inside a recess 17, and two bolts 18.

FIGS. 7 and 8 represent embodiments of the examples of FIGS. 5 and 6. In accordance with FIG. 7 an additional profile or guide element 19, for example a double-T-rail-like profile, is attached to the connecting element 14, preferably by welding; the profile 19 can be present in sections or over the entire length of the plate. It is used to lastingly prevent a movement in respect to each other of the plates 5 resting on each other with the blunt edges 7.

In accordance with FIG. 8 the bracket 16 of FIG. 6 is connected, preferably by welding, with a continuous profile 20. In addition, a counter bracket 21 can be advantageous for the mutual stabilization of the plates 5 placed on each other. Part A of FIG. 8 represents a view of the connecting point looking vertically on the plate surface, Part B of FIG. 8 shows a section vertically in respect to the plate surface. In accordance with Part B of FIG. 8, in the area of the connecting points the blunt edge 7 of the plate, which preferably is embodied as a square pressure cross beam, is formed into a narrow bar 22 with a bore for a bolt 23.

Further embodiments of the protective rail 9 in accordance with the invention are represented in FIGS. 9 and 10, which are specially designed for the connection of lining plates positioned with cutting edge on cutting edge. The protective rail 9 in accordance with FIG. 9 has bores 24 for bolts 25, which are intended to be placed through cutting edge bores or cutting edge eyes 26 in the respective cutting edge 6. The protective rail 9 of FIG. 10 is changed in respect to the one in FIG. 9 in such a way that the cutting edges essentially rest interlockingly against not only the oblique side of the cutting edge 9, but also—for improved rigidity—against the back 28 of the cutting edge embodied as a straight continuation of the surface of the plate 5.

In accordance with FIG. 11 a single bolt 29, which is drawn through the two cutting edge eyes 26, can also be directly sufficient as connecting means for the two cutting edges 6. At least two of such bolt connections should then be provided over the length of the cutting edges 6.

Figure 12:
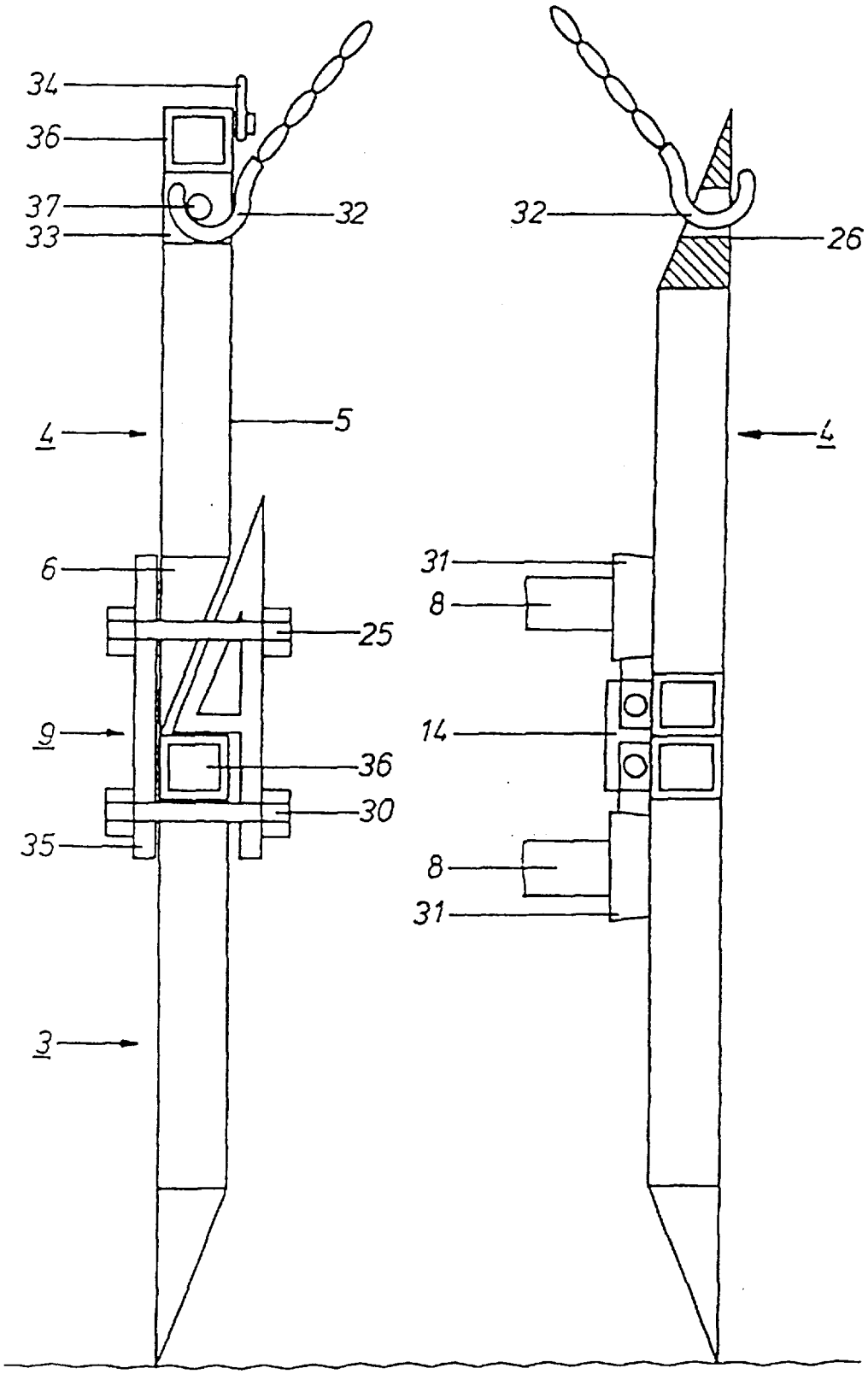
FIG. 12, a two tier lining box with connected lining plates which are symbolically arranged differently on top of and connected with each other.

Further exemplary embodiments of plate connections or protective rails are represented among others in principle in FIG. 12. The braces, which are naturally required in the trench lining in accordance with FIG. 12, for keeping the tiers of lining plates placed on top of each other apart, are essentially not drawn in for reasons of greater clarity.

A protective rail 9 which is specially embodied for the case of an arrangement of a cutting edge on a blunt edge is represented on the left side of FIG. 12. It includes an elongated clamp 35. The actual protective rail 9 lies on the cutting edge 6 of the upper plate 5, while the clamp 35 also essentially overlaps the pressure cross beam 36 or the blunt edge 7 of the lower plate in an interlocking manner. It is furthermore possible to provide bolts 25 and 30 (for making a tension-resistant connection), which in the upper area pass through the cutting edge 6 and in the lower area through the plate 5. A blunt edge to blunt edge connection is provided on the right side of the lower one of the plates of FIG. 12 placed on top of each other, which essentially corresponds to the exemplary embodiment of FIG. 5. Here the connecting bracket 14 is provided between the two resilient shoes 31, for example in accordance with DE 43 41 626 C1, in which braces 8 are seated which support the two plate walls against each other.

Means are also represented in principle in FIG. 12, with whose aid a trench lining device with two or more tiers of lining boxes is intended to be pulled out of a finished trench. If, as represented on the right side of FIG. 12, the topmost lining box 4 stands with the cutting edge 6 facing up, the respective crane hook 32 can engage a cutting edge eye 26 provided in the cutting edge. If, however, the lining box terminates with a blunt edge at the top (as is natural in case of the lowermost base box), the crane hook 32 in the customary manner can engage an engagement opening or planar eye 33 provided in the plate and having, for example, a holding bolt 37, in a ring 34 or the like attached to the pressure cross beam or blunt edge.

It is possible to raise a trench lining device, in which the oppositely located lining boxes are maintained at a distance from each other and wherein the lining plates of the base box have a cutting edge on the one longitudinal edge for driving into the soil, to twice or several times the height with the aid of the lining plates having the cutting edges if, when using the same lining plates, protective rails are provided for the base boxes and the raised boxes at the joint line of lining plates placed on top of each other, which prevent the mutual displacement of the lining boxes when they are driven in or separated during removal.

List of Reference Numerals

1=Trench
2=Soil
3=Base box
4=First raised box
5=Lining plate
6=Cutting edge
7=Blunt edge
8=Brace
9=Protective rail
10=Edge profile
11=Recess (10)
12=Second raised box
13=Bracket
14=Connecting element
15=Bolt
16=Bracket
17=Recess (for 16)
18=Bolt
19=Profile (14)
20=Rail
21=Counter bracket
22=Bar
23=Bolt
24=Bore
25=Bolt
26=Cutting edge eye
27=Oblique side (6)
28=Back of the cutting edge
29,30=Bolt
31=Resilient shoe
32=Crane hook
33=Planar eye
34=Ring
35=Clamp
36=Pressure cross beam
37=Holding Bolt (in 33)

What is claimed is:

1. A trench lining device in the form of a lining box comprising:

a) a base box (3) including lining plates (5), kept apart by braces (8), the lining plates (5) each having a blunt edge (7) and a square pressure cross beam (36), which is relatively stable against blows of an excavator bucket on the upper edge of the lining plates (5), and further including on the underside of each of the lining plates (5) a cutting edge (6) for forcing the base box (3) downward into the ground (2), b) at least one tier of the lining plates (5) defining a raised box (4, 12) arranged aligned on the base box (3), c) wherein the lining plates (5) of the raised box (4, 12) are substantially identical to the lining plates (5) of the base box (3), and further including at least one protective rail (9) attached to the cutting edge (6) of at least one of the lining plates (5) standing on the base box (3) and being in the form of a master mold to receive the cutting edge (6) essentially in an interlocking manner.

2. The trench lining device in accordance with claim 1, further comprising a connecting means for preventing the movement against each other of the lining plates (5) in the course of pushing the lining plates (5) in or during separation in the course of removal, the connecting means being provided at the joint lines of the lining plates (5) placed on top of each other.

3. The trench lining device in accordance with claim 1, wherein the lining plates (5) of the raised box (4) standing on the lining plates (5) of the base box (3) are positioned on top of each other with the blunt edge on the other blunt edge of each and with the cutting edge (6) oriented upward, and further including welded-on brackets (13) and connecting elements (14) for connecting the blunt edges of the lining plates (5) of the base box (3) and the raised box (4).

4. The trench lining device in accordance with claim 3, further including rails (19, 20) adapted to be pushed between the blunt edges (7) of the lining plates (5) placed on top of each other and wherein the connecting elements (14) or the brackets (16) are fixedly connected with the rails (19, 20).

5. The trench lining device in accordance with claim 3, further including brackets (16) and bolts (15, 18), the brackets being adapted to be fastened on a plate surface or in a recess of the lining plates (5) with the bolts (15, 18).

6. The trench lining device in accordance with claim 1, wherein the protective rail (9) is attached on the arrangement of pairs of the lining plates (5) placed on top of each other and terminating on the upper edge with the cutting edge (6), the protective rail (9) having a pressure cross beam edge profile (10) in the form of a master mold of the cutting edge (6) extending over the length of the profile (10) and being adapted to receive the cutting edge (6) essentially in an interlocking manner.

7. The trench lining device in accordance with claim 6, wherein the master mold defines a recess (11) for receiving the cutting edge (6) in an interlocking manner and the recess (11) being adapted to cover the cutting edge (6) over the entire length of the cutting edge (6).

8. The trench lining device in accordance with claim 7, wherein the recess (11) includes breaks adapted for not affecting the rigidity of the edge profile (10).

9. The trench lining device in accordance with claim 6, wherein the center of gravity of the protective rail (9) is located below the upper edge of the cutting edge (6).

10. The trench lining device in accordance with claim 6, wherein the edge profile (10) defines an anvil element (10) and the thickness of the anvil element (10) is less than the thickness of the edge profile (10) in the direction parallel with the plane of the lining plate.

11. The trench lining device in accordance with claim 1, wherein the lining plates (5) of the raised box (4) standing on the base box (3) are positioned with the cutting edge (6) of the lining plates of the raised box (4) on the blunt edges (7) of the lining plates (5) of the base box (3) and the protective rail (9) is interposed therebetween.

12. The trench lining device in accordance with claim 1, further including a second raised box (12) defined by the lining plates (5) placed in a third tier on the first raised box (4) and positioned with the cutting edge of the lining plates of the second raised box to the cutting edge of the lining plates of the first raised box or the blunt edge of the lining plates of the second raised box to the blunt edge of the lining plates of the first raised box or the cutting edge of the lining plates of the second raised box to the blunt edge of the lining plates of the first raised box or the blunt edge of the lining plates of the second raised box to the cutting edge of the lining plates of the first raised box.

13. The trench lining device in accordance with claim 1, wherein the cutting edge (6) is selectively placed on the blunt edge (7) or two of the cutting edges (6) of the lining plates (5) are placed against each other, the protective rail (9) defining an attached clamp (35) positioned at the transition between the lining plates (5) placed on top of each other and being adapted to interlockingly grip around the blunt edge (7) for preventing a direct mutual contact of the lining plates (5) standing on top of each other.

14. The trench lining device in accordance with claim 1, wherein the lining plates (5) include bores (26,30) leading through the cutting edges (6) or lining plates (5) and wherein the protective rail (9) interlockingly grips around the cutting edges (6) or the blunt edges (7) and are connected with each other by the use of bores (26, 30).

15. The trench lining device in accordance with claim 1, wherein the protective rail (9) has connecting elements for fixed connection with the adjoining lining plates (5) and has guide elements for preventing mutual displacement of the lining plates placed on top of each other.

16. A trench lining device in the form of a lining box comprising:

a) a base box (3) including lining plates (5), kept apart by braces (8), the lining plates (5) each having a blunt edge (7) and a square pressure cross beam (36), which is relatively stable against blows of an excavator bucket on the upper edge of the lining plates (5), and further including on the underside of each of the lining plates (5) a cutting edge (6) for forcing the base box (3) downward into the ground (2), b) at least one tier of the lining plates (5) defining a raised box (4, 12) arranged aligned on the base box (3), c) wherein the lining plates (5) of the raised box (4, 12) are substantially identical to the lining plates (5) of the base box (3) and the cutting edge (6) is placed on the blunt edge (7) or two cutting edges (6) of the lining plates (5) of the raised box and the base box are placed against each other, and d) a protective rail (9) including an attached clamp (35) positioned at the transition between the lining plates (5) placed on top of each other and adapted to interlockingly grip around the blunt edge (7) and prevent a direct mutual contact of the lining plates (5) standing on top of each other.

17. A trench lining device in the form of a lining box comprising:

a) a base box (3) including lining plates (5), kept apart by braces (8), the lining plates (5) each having a blunt edge (7) and a square pressure cross beam (36), which is relatively stable against blows of an excavator bucket on the upper edge of the lining plates (5), and further including on the underside of each of the lining plates (5) a cutting edge (6) for forcing the base box (3) downward into the ground (2), b) at least one tier of the lining plates (5) defining a raised box (4, 12) arranged aligned on the base box (3), c) wherein the lining plates (5) of the raised box (4, 12) are substantially identical to the lining plates (5) of the base box (3) and further include bores (26,30) leading through the cutting edges (6) or lining plates (5), d) a protective rail adapted to interlockingly grip around the cutting edges (6) or blunt edges (7), and e) wherein the protective rail and the cutting edges (6) or blunt edges (7) are connected with each other by the use of the bores (26, 30).

18. A trench lining device in the form of a lining box comprising:

a) a base box (3) including lining plates (5), kept apart by braces (8), the lining plates (5) each having a blunt edge (7) and a square pressure cross beam (36), which is relatively stable against blows of an excavator bucket on the upper edge of the lining plates (5), and further including on the underside of each of the lining plates (5) a cutting edge (6) for forcing the base box (3) downward into the ground (2), b) at least one tier of the lining plates (5) defining a raised box (4, 12) arranged aligned on the base box (3), c) wherein the lining plates (5) of the raised box (4, 12) are substantially identical to the lining plates (5) of the base box (3), and d) a protective rail (9) having connecting elements for the fixed connection with the adjoining lining plates (5) and having guide elements for preventing mutual displacement of the lining plates placed on top of each other.

19. A trench lining device in the form of a lining box comprising:

a) a base box (3) including lining plates (5), kept apart by braces (8), the lining plates (5) each having a blunt edge (7) and a square pressure cross beam (36), which is relatively stable against blows of an excavator bucket on the upper edge of the lining plates (5), and further including on the underside of each of the lining plates (5) a cutting edge (6) for forcing the base box (3) downward into the ground (2), b) at least one tier of the lining plates (5) defining a raised box (4, 12) arranged aligned on the base box (3), c) wherein the lining plates (5) of the raised box (4, 12) are substantially identical to the lining plates (5) of the base box (3), and d) at least one protective rail (9) attached to the cutting edge (6) of the lining plates (5) standing on the base box (3), the protective rail (9) comprising an edge profile (10) in the form of a master mold of the cutting edge (6) extending over the length of the edge profile (10) and adapted to receive the cutting edge (6) essentially in an interlocking manner.

* * * * *